US009628881B2

(12) United States Patent
Huang et al.

(10) Patent No.: US 9,628,881 B2
(45) Date of Patent: Apr. 18, 2017

(54) SPEAKER

(71) Applicants: Jinquan Huang, Shenzhen (CN); Bo Xiao, Shenzhen (CN); Qiaoling Li, Shenzhen (CN)

(72) Inventors: Jinquan Huang, Shenzhen (CN); Bo Xiao, Shenzhen (CN); Qiaoling Li, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/000,564

(22) Filed: Jan. 19, 2016

(65) Prior Publication Data

US 2016/0241938 A1 Aug. 18, 2016

(30) Foreign Application Priority Data

Feb. 13, 2015 (CN) ..... 2015 2 0111749 U

(51) Int. Cl.

| | |
|---|---|
| ***H04R 25/00*** | (2006.01) |
| ***H04R 1/02*** | (2006.01) |
| *H04R 1/00* | (2006.01) |

(52) U.S. Cl.
CPC ..... *H04R 1/023* (2013.01); *H04R 2499/11* (2013.01)

(58) Field of Classification Search
CPC ..... H04R 9/025; H04R 2499/11; H04R 1/023
USPC ..... 381/404, 405, 412, 408, 409, 431, 423, 381/396, 398, 399
See application file for complete search history.

(56) References Cited

U.S. PATENT DOCUMENTS

2013/0016874 A1* 1/2013 Huang ..... H04R 9/043 381/433

* cited by examiner

*Primary Examiner* — Sunita Joshi
(74) *Attorney, Agent, or Firm* — Na Xu; IPro, PLLC

(57) ABSTRACT

The present disclosure discloses a speaker including a frame with a receiving space; a conductive element assembled with the frame; and a vibration system positioned by the frame, including a diaphragm received in the receiving space and a voice coil driving the diaphragm. The diaphragm divides the receiving space into a front cavity above the diaphragm and a rear cavity below the diaphragm. The frame includes an upper surface facing the diaphragm and an assemble surface opposed to the upper surface, and the conductive element includes a first conducting part disposed out of the assemble surface for electrically connecting to the voice coil.

4 Claims, 3 Drawing Sheets

SPEAKER

FIELD OF THE INVENTION

The present invention relates to speakers for converting electrical signals into sound waves, and more particularly related to a speaker with high level of water-proof.

DESCRIPTION OF RELATED ART

The cell phone and other mobile and portable communication equipment are often used in the wet environment or in the rain, which set the requirements to the water-proof performance of the speaker, which is one of the necessary element of the mobile and portable communication equipment.

However, there are still the existing problems for the speakers, which might reduce their water-proof level. The first, the inversion structure of the typical speaker is generally to open the large sound hole on the front cover (the size of the hole is larger than the inner diameter of the hole), and it will make the area of the front cover without hole is very small, and it also makes the area of the water-proof liner or the water-proof adhesive tap is very small; the sound hole is too large and it will reduce the water-proof performance. The second, the outlet wire socket of the speaker is often nearby the front cover, and it makes the sealing performance of the front cavity is not very high.

Therefore, it is necessary to provide an improved speaker box to solve the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
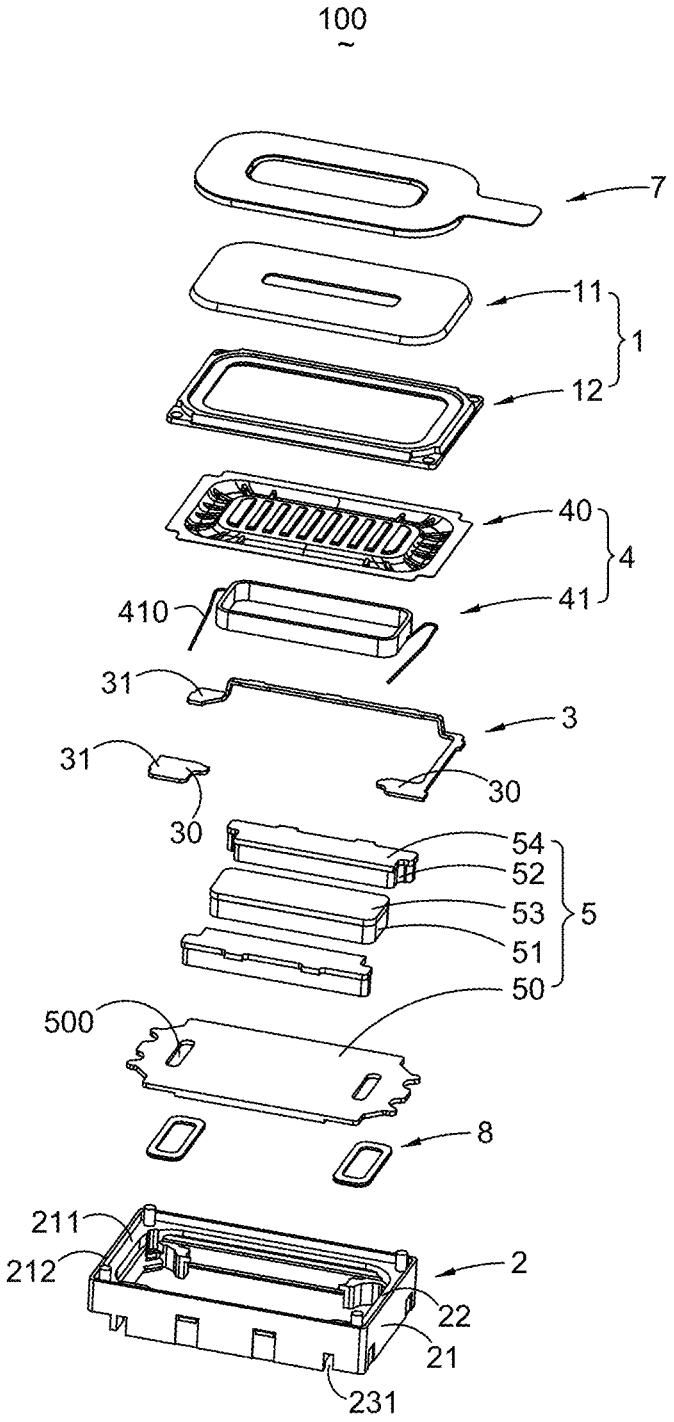
FIG. 1 is an isometric and exploded view of a speaker in accordance with an exemplary embodiment of the present disclosure.
Figure 2:
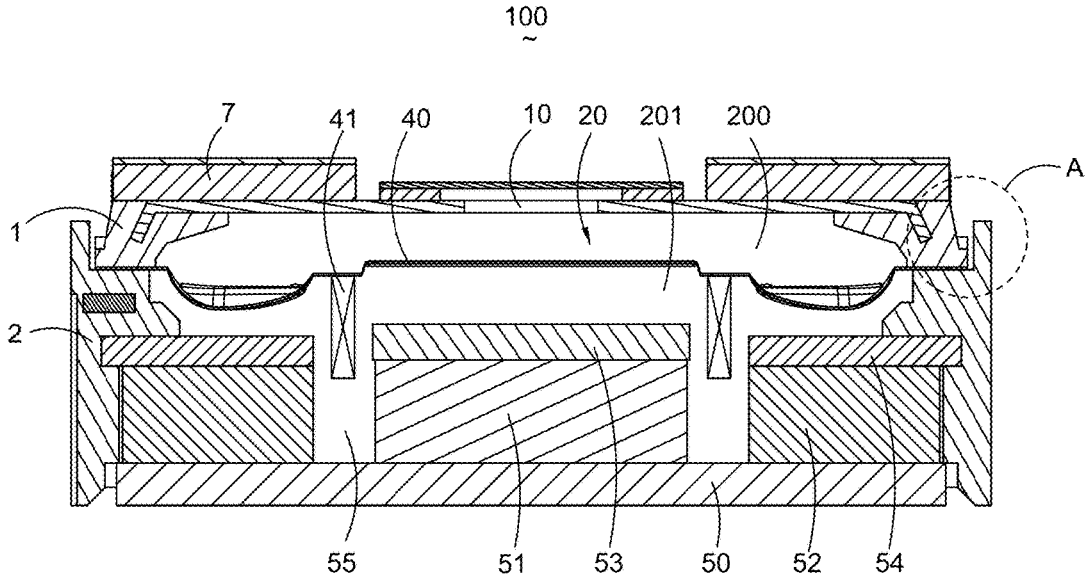
FIG. 2 is a cross-sectional view of the speaker in FIG. 1.

Referring to FIGS. 1 and 2, this disclosure discloses a speaker 100 in accordance with an exemplary embodiment, including a frame 2 with a receiving space 20, a front cover 1 assembled with the frame 2, a conducting terminal 3 coupled to the frame 2 for electrically connecting the speaker 100, a vibration system 4 positioned by the frame 2, and a magnetic circuit 5 positioned by the frame 2 to drive the vibration system 4 for generating sound by vibration.

The vibration system 4 includes a vibration diaphragm 40 and a voice coil 41 driving the vibration diaphragm 40 to vibrate for sound generation and with the inducting wire for voice coil 410; the vibration diaphragm 40 is fixed on the frame 2 via the front cover 1. The vibration diaphragm 40 is received in the receiving space 20, and the vibration diaphragm 40 divides the receiving space 20 into a front cavity 200 above the vibration diaphragm and between the diaphragm 40 and the front cover 1, and a rear cavity 201 under the vibration diaphragm 40.

The magnetic circuit 5 includes a magnetic yoke 50 at a bottom of the frame 2, a central magnet 51 positioned on a central portion of the magnetic yoke 50, a plurality of auxiliary magnets 52 surrounding the central magnet 51, a main pole plate 53 attached to a top of the central magnet 51, a plurality of auxiliary pole plates 54 attached to the auxiliary magnets 52 respectively, and a magnetic gap 55 formed between the central magnet 51 and the auxiliary magnets 52. A part of the voice coil 41 is suspending in the magnetic gap 55 and it will generate ampere force in the magnetic gap 55 and drive the vibration diaphragm 40 to vibrate for sound generation. The magnetic yoke 50 includes a vent 500 penetrating the magnetic yoke 50, and the vent 500 is covered by a protecting mesh 8. The protective mesh 8 can prevent the dust and moisture entering inside the speaker 100 effectively.

Figure 4:
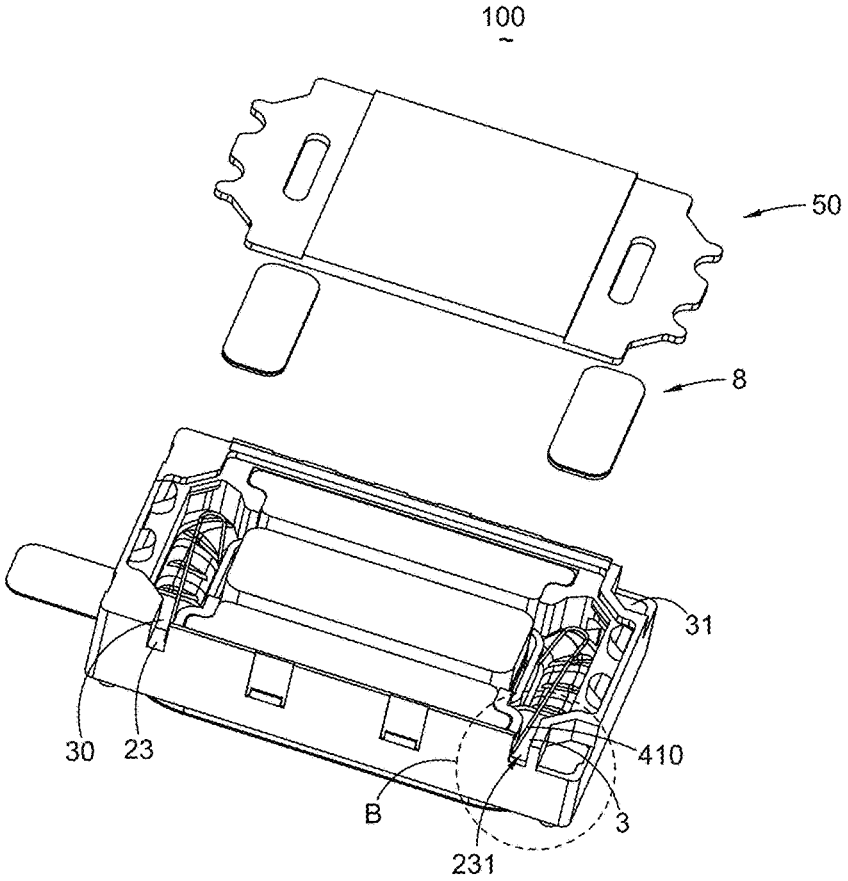
FIG. 4 is an isometric and exploded view of the speaker in FIG. 1, with some elements thereof removed.
Figure 5:
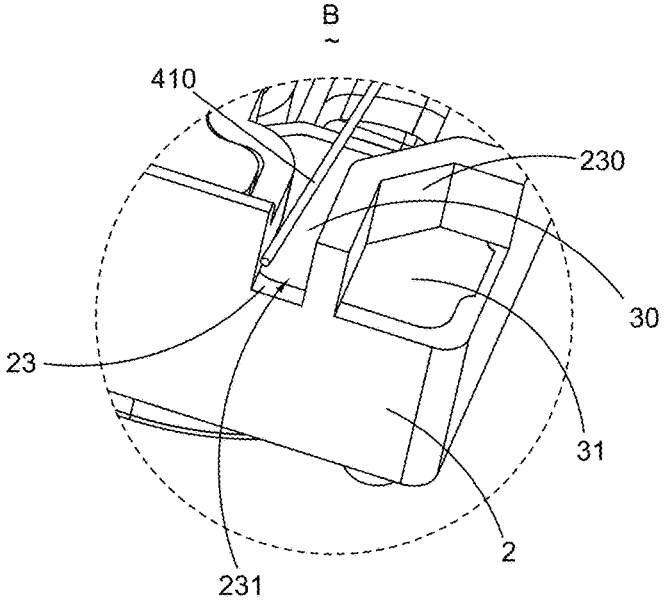
FIG. 5 is an enlarged view of circle part B in FIG. 4.

As is shown in FIG. 4 and FIG. 5, the frame 2 includes an upper surface 22 facing the diaphragm 40 and an assembly surface 23 opposing to the upper surface 22. The conducting terminal 3 includes a first conducting part 30 exposed out of the assembly surface 23 and a second conducting part 31 extending from the first conducting part 30 and connecting to outside. The voice coil 410 is electrically connected to the first conducting part 30. In present exemplary embodiment, the assembly surface 23 includes a side 230 extending in a direction far away from the vibration diaphragm 40 and forms a groove 231 communicating with the rear cavity, and optionally the side 230 is perpendicular to the assembly surface 23. The magnetic yoke 50 covers the groove 231. The first conducting part 30 is exposed to the bottom of the groove 231, and the inducing wire of the voice coil 410 extends to the groove 231 and is fixed on the first conducting part 30.

The existence of the groove 231 can make the inducing wire of the voice coil 410 welded and fixed on the conducting terminal 3 conveniently when assembling the speaker 100, and it has the effect of abdication. The groove 231 optionally penetrates the side wall 230 in the vibration direction perpendicular to the vibration diaphragm 40 and makes the rear cavity 201 communicating with outside via the groove 231, which not only increases the welding area between the inducting wire of the voice coil 410 and the conducting terminal, but also makes the welding of the inducting wire of the voice coil 410 more tightly. Further, it is also beneficial for adjusting the air pressure of the rear cavity 201, and improves the acoustic performance of the speaker 100.

Figure 3:
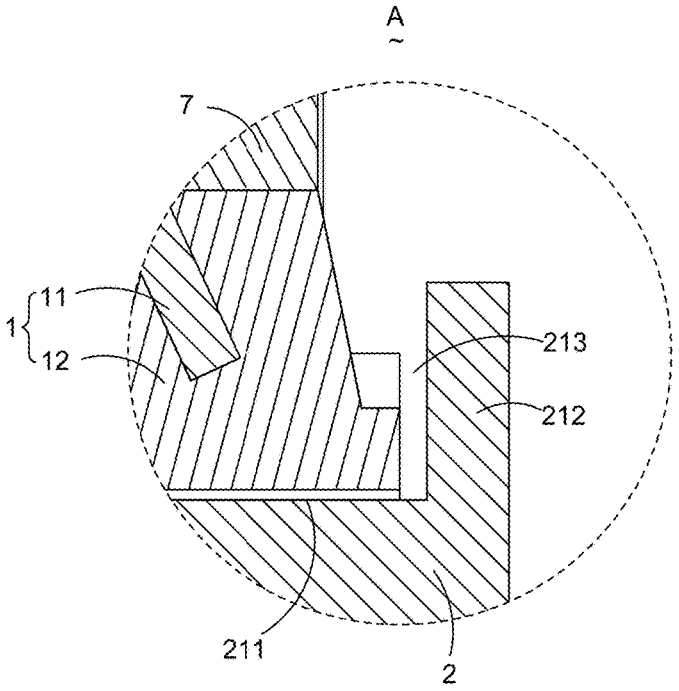
FIG. 3 is an enlarged view of circled part A in FIG. 2.

The frame 2 includes a side wall 21, a step 211 inside the side wall 21, a barricade 212 extending from an edge of the stage part 211, and a slot 213 formed between the barricade 212 and the front cover 1, as shown in FIG. 3. The slot 213 is used for being filled with glue for enhancing the connection between the frame 2 and the front cover 1, and further for sealing the clearance between the frame 2 and the front cover, which improves the water-proof performance of the speaker.

The front cover 1 includes a cover body 11 and a gasket 12 coupled with the cover body 11. The slot 213 locates between the barricade 212 and the gasket 12. A sound hole 10 is provided and penetrates the front cover 1 for being communicating with the front cavity 200. Optionally, an area of the sound hole 10 is smaller than a cross-sectional area of the voice coil 41. It is suggested that the area of the sound hole 10 is ⅕~½ of the cross-sectional area of the voice coil 40. The smaller area of the sound hole 10 enhances the sealing performance of the front cavity 200.

The front cover 1 further includes a sealing element 7 covering the sound hole 10 for prevent water or dust entering the speaker 100. The sealing element 7 may be multi-layer water-proof lining, or multi-layer water-proof adhesive. The sealing element 7 further improves the water proof level.

Compared with the related technology, the speaker 100 is provided with improved seal performance and higher level water-proof performance, by the configuration of the sound hole with an area smaller than an area of the voice coil. And the slot formed between the front cover and the frame further enhances the seal performance of the speaker. By virtue of the configuration mentioned above, the water-proof level of the speaker may be brought to IPX8.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a frame with a receiving space;

a conductive element assembled with the frame;

a vibration system positioned by the frame, including a diaphragm received in the receiving space and a voice coil driving the diaphragm, the diaphragm dividing the receiving space into a front cavity above the diaphragm and a rear cavity below the diaphragm;

a magnetic circuit positioned by the frame to drive the vibration system for generating sound;

wherein the frame includes an upper surface facing the diaphragm and an assemble surface opposed to the upper surface, and the conductive element includes a first conducting part disposed out of the assemble surface for electrically connecting to the voice coil;

the assembly surface further includes a side wall, a groove formed on the side wall and communicating with the rear cavity, the first conducting part is exposed to the bottom of the groove, the inducing wire of the voice coil extends to the groove and the inducing wire is fixed on the first conducting part.

2. The speaker as described in claim 1 further including a front cover coupled with the frame, wherein the front cover includes a sound hole penetrating therethrough communicating with the front cavity, an area of the sound hole is smaller than a cross-sectional area of the voice coil, and the area of the sound hole 10 is ⅕~½ of the cross-sectional area of the voice coil.

3. The speaker as described in claim 2, wherein the frame includes a side wall having a step, a barricade extending from an edge of the step, a slot formed between the barricade and the front cover so as to fill with glue.

4. The speaker as described in claim 3 further including a sealing element covering the sound hole, the sealing element being a multi-laver water-proof lining or a multi-laver water-proof adhesive.

* * * * *